US006833343B2

(12) United States Patent
Aoyagi et al.

(10) Patent No.: US 6,833,343 B2
(45) Date of Patent: Dec. 21, 2004

(54) BLEACHING DETERGENT FORMULATION

(75) Inventors: Muneo Aoyagi, Tokyo (JP); Hiroshi Danjo, Wakayama (JP); Masakazu Furukawa, Wakayama (JP); Kazuyoshi Ozaki, Wakayama (JP)

(73) Assignee: Kao Corporation, Tokyo (JP)

( * ) Notice: Subject to any disclaimer, the term of this patent is extended or adjusted under 35 U.S.C. 154(b) by 274 days.

(21) Appl. No.: 10/108,566

(22) Filed: Mar. 29, 2002

(65) Prior Publication Data

US 2003/0060388 A1 Mar. 27, 2003

(30) Foreign Application Priority Data

Mar. 30, 2001 (JP) ..... P. 2001-098893
Mar. 30, 2001 (JP) ..... P. 2001-098894

(51) Int. Cl.[7] ..... C11D 1/14; C11D 1/29; C11D 3/39; C11D 17/00

(52) U.S. Cl. ..... 510/311; 510/313; 510/357; 510/372; 510/376; 510/303; 252/186.38; 502/200; 502/324; 502/325

(58) Field of Search ..... 510/303, 311, 510/313, 357, 372, 376; 252/186.38; 502/200, 324, 325

(56) References Cited

U.S. PATENT DOCUMENTS 5,853,428 A * 12/1998 Collins et al. ..... 8/107
5,935,708 A * 8/1999 Schuette et al. ..... 428/403
6,099,586 A * 8/2000 Collins et al. ..... 8/111
6,413,927 B1 * 7/2002 Horne et al. ..... 510/441
6,465,408 B1 * 10/2002 Lee et al. ..... 510/349

FOREIGN PATENT DOCUMENTS

JP 2000-515194 A 11/2000
JP 2001-503073 A 3/2001
WO WO97/29174 * 8/1997
WO WO99/55818 * 11/1999

* cited by examiner

*Primary Examiner*—Gregory R. Del Cotto
(74) *Attorney, Agent, or Firm*—Birch, Stewart, Kolasch & Birch, LLP

(57) ABSTRACT

A bleaching detergent formulation comprising the components of: (A) particles comprising 0.01 to 50% by weight, based on the particles, of a compound represented by formula (I):

(I)

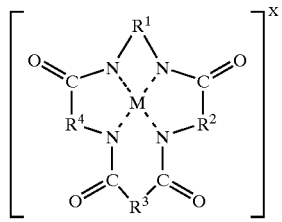

wherein $R^1$ represents a straight-chain alkylene or alkenylene group having 2 to 8 carbon atoms, a cycloalkylene or cycloalkenylene group having 3 to 8 carbon atoms or a phenylene group; $R^2$, $R^3$ and $R^4$, which may be the same or different, each represent a methylene group, a straight-chain alkylene or alkenylene group having 2 to 8 carbon atoms, a cycloalkylene group having 3 to 8 carbon atoms or a phenylene group; $R^1$, $R^2$, $R^3$ and $R^4$ may each have a substituent or substituents selected from an alkyl, alkenyl, alkynyl, alkoxy or halogenated alkyl group having up to 8 carbon atoms, a cycloalkyl or cycloalkenyl group having 3 to 8 carbon atoms, an aryl group, an aryl group having a straight-chain alkyl group having 1 to 18 carbon atoms, a hydroxyl group, a phenoxy group, a halogen atom, an amino group, a sulfuric acid radical, a sulfo group, a nitro group, and a carboxyl group; M represents a metal selected from transition metals having a I, II, III, IV, V, VI, VII or VIII-valent oxidized state; and X represents a counter ion in equilibrium with the compound's charges on a stoichiometric basis; and (B) a percarbonate.

14 Claims, No Drawings

BLEACHING DETERGENT FORMULATION

FIELD OF THE INVENTION

This invention relates to a bleaching detergent formulation.

BACKGROUND OF THE INVENTION

Oxygen bleaches such as hydrogen peroxide and inorganic peroxides have been used in laundry to remove stains or yellowing from clothes. Use of bleach catalysts has also been attempted for enhancement of bleaching effect.

Having extremely high bleaching effect, bleach catalysts have recently been under intensive study. JP-A-4-216899 (The term "JP-A" as used herein means an "unexamined published Japanese patent application") reports the excellent bleaching effect produced by a manganese catalyst, and JP-W-10-513215 (The term "JP-W" as used herein means an "international patent application published in the Japanese national proceeding") discloses usefulness of a cobalt catalyst as a bleaching agent for rigid surfaces. However, conventional bleach catalysts often damage laundry, and fabric-friendly bleach formulations have been of keen desire.

For the purpose of reducing fabric damage, JP-A-9-25499 proposes use of a bleach catalyst in conjunction with a clay mineral compound; JP-W-9-511774 suggests a combined use of a free-radical-scavenging antioxidant; and JP-W-9-511775 discloses a bleaching detergent composition less causative of textile damage which contains a metal complex catalyst in combination with a specific bleach activator. Any of these techniques is incapable of preventing fabric damage to a satisfactory extent.

JP-W-12-515194 and JP-W-13-503073 disclose that a metal complex having a macrocyclic tetraamide ligand, which ligand is used in the present invention, is useful as a catalyst in bleaching lignin of pulp, suggesting applicability to household bleach. However, sufficient bleaching effect has not been attained with this bleach catalyst when applied to household use. Besides, this bleach catalyst reduces its effect in storage.

SUMMARY OF THE INVENTION

An object of the present invention is to provide a bleaching detergent formulation which exhibits a high bleaching effect without damaging clothes and also has high storage stability.

The present invention provides a bleaching detergent formulation comprising (A) particles containing 0.01 to 50% by weight, based on the particles, of (a) a compound represented by formula (I):

(I)

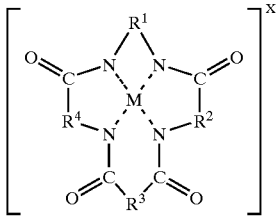

wherein $R^1$ represents a straight-chain alkylene or alkenylene group having 2 to 8 carbon atoms, a cycloalkylene or cycloalkenylene group having 3 to 8 carbon atoms or a phenylene group; $R^2$, $R^3$ and $R^4$, which may be the same or different, each represent a methylene group, a straight-chain alkylene or alkenylene group having 2 to 8 carbon atoms, a cycloalkylene group having 3 to 8 carbon atoms or a phenylene group; $R^1$, $R^2$, $R^3$ and $R^4$ may each have a substituent(s) selected from an alkyl, alkenyl, alkynyl, alkoxy or halogenated alkyl group having up to 8 carbon atoms, a cycloalkyl or cycloalkenyl group having 3 to 8 carbon atoms, an aryl group, an aryl group having a straight-chain alkyl group having 1 to 18 carbon atoms, a hydroxyl group, a phenoxy group, a halogen atom, an amino group, a sulfuric acid radical, a sulfo group, a nitro group, and a carboxyl group; M represents a metal selected from transition metals having a I, II, III, IV, V, VI, VII or VIII-valent oxidized state; and X represents a counter ion in equilibrium with the compound's charges on a stoichiometric basis, and (B) a percarbonate.

DETAILED DESCRIPTION OF THE INVENTION

In formula (I) representing the tetraamide compound used as component (a), $R^1$ is preferably a substituted or unsubstituted alkylene group or a substituted or unsubstituted phenylene group, still preferably a phenylene group, particularly preferably an orthophenylene group. $R^2$, $R^3$ and $R^4$ are each preferably a substituted or unsubstituted alkylene group having 1 to 8, particularly 1 to 6, especially 1 to 3, carbon atoms. M is preferably Fe. X is preferably an ammonium ion, particularly a tetraalkylammonium ion having 2 to 10 carbon atoms in each alkyl group thereof. The tetraamide complexes represented by formula (I) can be synthesized by, for example, the process taught in JP-W-12-515152.

The particles containing component (a) will hereinafter be referred to as particles (A). Particles (A) preferably have a component (a) content of from 0.01 to 50% by weight. To ensure storage stability of the formulation, a preferred content of component (a) in particles (A) is 0.05 to 20% by weight, particularly 0.05 to 10% by weight.

Component (a) is compounded as particles (A) prepared from a mixture of component (a) and other compounds hereinafter described. Particles (A) containing component (a) are preferably those prepared by granulating the compound of formula (I) with the aid of a binder which develops tack or film-forming properties at or above 30° C. and does not melt below 30° C. Preferred binders are compounds having a melting point of 30 to 90° C., particularly 40 to 70° C. Suitable binders include polyalkylene glycols, nonionic surface active agents, fatty acids, and polymers.

Polyalkylene glycols as a binder preferably include polyethylene glycol. Polyethylene glycol to be used preferably has a weight average molecular weight of 2,000 to 20,000, particularly 4,000 to 10,000, especially 4,000 to 8,000, as measured by gel-permeation chromatography (GPC) using polyethylene glycol as a standard.

Nonionic surface active agents preferred as a binder include polyalkylene glycol alkyl ethers having an average of 15 to 300 moles, desirably 20 to 200 moles, more desirably 20 to 150 moles, of an alkylene oxide, 10 to 18 carbon atoms in the alkylene chain, and 8 to 22 carbon atoms, particularly 10 to 20 carbon atoms, in the alkyl moiety. Particularly preferred are those having an average of 20 to 150 moles of an alkylene oxide (preferably an ethylene oxide) and an alkyl group derived from a branched or secondary alcohol containing an average of 12 to 14 carbon atoms.

Fatty acids preferred as a binder include saturated ones having 12 to 18, particularly 12 to 16, carbon atoms. The fatty acids may be either in a free form or a salt form, such as a sodium salt or a potassium salt.

Polymers preferred as a binder include polyinylpyrrolidone, polyinyl alcohol, carboxymethyl cellulose, hydroxyethyl cellulose, polyacrylic acid, and polyhydroxyacrylic acid.

Taking solubility and storage stability of component (a) into consideration, particularly preferred of these binders are polyethylene glycol having a weight average molecular weight of 4,000 to 8,000, saturated fatty acids having 12 to 16 carbon atoms, and mixtures thereof.

It is preferred for particles (A) to further contain an anionic surface active agent (exclusive of ones recited above as binder) to improve solubility of the compound of formula (I) in laundering. Suitable anionic surface active agents include alkylsulfates, polyoxyethylene alkyl ether sulfates, and mixtures thereof. Preferred alkyl sulfates are alkali metal (e.g., sodium) salts of alkyl sulfuric acids having 10 to 18 carbon atoms in the alkyl moiety, particularly sodium lauryl sulfate and sodium myristyl sulfate. Preferred polyoxyethylene alkyl ether sulfates are sodium salts of polyoxyethylene alkyl ether sulfates having 10 to 18 carbon atoms in the alkyl moiety thereof. The average degree of polymerization of the ethylene oxide (hereinafter represented by POE) is 1 to 10, preferably 1 to 5. Sodium polyoxyethylene lauryl ether sulfate (POE=2 to 5) or sodium polyoxyethylene myristyl ether sulfate (POE=2 to 5) are particularly satisfactory.

It is preferred for particles (A) to furthermore contain a diluent to help component (a) be dispersed thereby to prevent non-uniform bleaching. Suitable diluents include inorganic salts, such as hydrochlorides, phosphates, sulfates, sulfites, nitrates, and carbonates (especially sodium sulfate, sodium carbonate, and sodium phosphate); organic acids, such as acetic acid, citric acid, succinic acid, malic acid, and tartaric acid, and salts thereof; cellulosic compounds, such as microcrystalline cellulose and cellulose derivatives (especially those recrystallized into finely divided particles); saccharides (e.g., sorbitol); and swellable clay compounds (e.g., fine smectite powder). It is particularly effective for improving solubility to use at least one diluent selected from sodium acetate, sodium succinate, sodium tripolyphosphate, and microcrystalline cellulose or a combination of an alkali metal carbonate and an organic acid.

Particles (A) can additionally contain (D) a bleach activator (described later) to improve the bleaching power.

Particles (A) preferably contains one or more of the aforementioned binder, anionic surface active agent, and diluent in an amount of 50 to 99.99% by weight, particularly 80 to 99.95% by weight, especially 90 to 99.95% by weight. The most desirable formulation of particles (A) comprises 0.05 to 10% by weight of component (a), 5 to 95% by weight of a binder, 1 to 20% by weight of an anionic surface active agent, 1 to 40% by weight of a diluent, and 0 to 20% by weight of component (D).

These components are mixed and granulated in a conventional manner. Better results are obtained by adding the binder in a molten state. The binder can previously be melted at 40 to 100° C., preferably 50 to 100° C., still preferably 50 to 90° C. The components are uniformly mixed with stirring and granulated preferably by rolling or extrusion by use of a general granulator. The resulting granules (A) preferably have an average particle size of 500 to 5, 000 $\mu$m, particularly 500 to 3,000 $\mu$m. In view of storage stability, it is preferred for Particles (A) to have an apparent specific gravity of 0.1 to 1.5 g/ml, particularly 0.4 to 1.0 g/ml, especially 0.4 to 0.9 g/ml.

A method of making tablets by use of a bricket machine is also preferred for granulation. The terms "granules (or particles)" and "granulation" as used herein are intended to include particles having component (a) as a core coated with other components and operations for making such particles, respectively.

The bleaching detergent formulation of the invention preferably contains particles (A) in an amount of 0.1 to 20% by weight, particularly 0.1 to 10% by weight, to assure storage stability and bleaching effect. A preferred content of component (a) in the total bleaching detergent formulation is 0.0001 to 5% by weight, particularly 0.0001 to 3% by weight.

The percarbonate as component (B) is preferably sodium percarbonate (hereinafter referred to as PC). PC particles coated with a polymer, an inorganic salt, a solid inorganic acid, etc. are still preferred. It is preferred for component (B) to have a dissolution rate of 0.05 to 1.5 g/min, particularly 0.1 to 1.1 g/min, as measured according to the method described below. The dissolution rate can be adjusted by the amount of the coating material.

Method of Measuring Dissolution Rate:

One liter of ion-exchanged water (20° C.) is put into a 1 liter-volume glass beaker equipped with an electrical conductivity meter and stirred at 150 rpm by means of a magnetic stirrer and a stirrer bar (length: 52 mm; diameter: 15 mm). One gram of a percarbonate is added, and electrical conductivity is recorded with time until a steady state is reached. The time t (min) required for the conductivity increases to a half of the steady value is obtained. The rate of dissolution (g/min) is calculated by dividing 0.5 g with t min.

The coated PC which can be used in the invention includes those obtained by known processes disclosed, e.g., in JP-B-47-32200 (The term "JP-B" as used herein means an "examined Japanese patent application") (paraffin-coated PC), JP-B-53-15717 (sodium perborate-coated PC), U.S. Pat. No. 4,131,562 (PC and/or sodium perborate coated with an alcohol-ethylene oxide adduct), U.S. Pat. No. 4,120,812 (PC and/or sodium perborate coated with polyethylene glycole alkyl ethers), German Patent 2712139 (silicate-coated PC), German Patent 2800916 (boric acid-coated PC), European Patent 30759 (wax-coated PC), JP-A-58-217599 (borate-coated PC), JP-A-59-196399 (borate-coated PC), and JP-A-4-31498 (PC separately spray-coated with boric acid and a silicate).

Preferred coating materials include boric acid and its salts, silicates, carbonates, sulfates, phosphates, polyethylene glycol that is solid at 30° C., and waxes that are solid at 30° C. Boric acid, sodium borate, sodium silicate, and magnesium sulfate are still preferred. The coating material is used in an amount of 0.1 to 50% by weight, preferably 0.2 to 30% by weight, based on the percarbonate. The expression "coated" as used herein is intended to include such a state that a mixture of a percarbonate and a coating material is granulated.

In the present invention, component (B) is preferably (i) a percarbonate coated with 0.1 to 30% by weight (based on the percarbonate) of sodium borate, particularly sodium metaborate or sodium orthoborate, (ii) a percarbonate coated with 0.3 to 20% by weight, particularly 0.5 to 10% by weight, especially 1 to 8% by weight, (based on the percarbonate) of a boric acid selected from orthoboric acid, metaboric acid, and tetraboric acid or (iii) a percarbonate coated with 0.1 to 10% by weight, particularly 0.2 to 7% by weight, especially 0.3 to 5% by weight, (based on the percarbonate) in term of $SiO_2$ of a silicate, e.g., sodium metasilicate, sodium orthosilicate, Nos. 1, 2 or 3 water glass (sodium silicate specified in JIS K1408), potassium metasilicate or potassium orthosilicate, preferably No. 1, 2 or 3 water glass. Percarbonate particles coated with the coating material recited in (i) and the coating material recited in (ii) are particularly preferred for their improved storage stability.

The percarbonate is produced in a usual manner. The coated percarbonate can be produced by bringing the percarbonate, wet or dry, into contact with a coating material in the form of a solution or powder by mixing or adsorption and drying. Component (B) preferably has an average particle size of 100 to 2000 $\mu$m, preferably 250 to 1000 $\mu$m, for assuring bleaching performance.

A preferred content of component (B) in the bleaching detergent formulation is 0.5 to 99% by weight, particularly 1 to 95% by weight, especially 1 to 90% by weight. Component (B) is compounded in the form of particles independent from particles (A) containing component (a).

The bleaching detergent formulation preferably contains (C) an alkali agent in the form of particles independent from particles (A) to have enhanced bleaching and cleaning effect. Component (C) preferably includes alkali metal carbonates except component (B), silicates, alkanolamines, and alkali phosphates, with alkali metal carbonates and silicates being still preferred.

The alkali metal carbonates are preferably sodium salts, such as sodium carbonate, sodium hydrogen carbonate, and sodium sesquicarbonate, for their stability. Sodium carbonate is the most preferred. Component (C) may be dry blended with bleach activator particles (hereinafter described) or an inorganic peroxide. In this case, it is preferred to use alkali metal carbonate particles having an average particle size of 100 to 500 $\mu$m. Commercially available sodium carbonate products sold as heavy soda ash can be used as such. The alkali metal carbonate may be mixed with a surface active agent, zeolite, and other detergent auxiliaries, and the resulting slurry or kneaded mixture (intimate mixture) is dried to prepare a particulate detergent base, which is added to the bleaching detergent formulation. The alkali metal carbonate is added preferably in an amount of 0.5 to 60% by weight, particularly 1 to 50% by weight, based on the bleaching detergent formulation.

The silicates as component (C) preferably include amorphous sodium silicate, such as No. 1, 2 or 3 sodium silicate, crystalline silicates described in JP-A-7-89712, JP-A-60-227895, *Phys. Chem. Glasses*, vol.7, pp. 127–138 (1966), and *Z. Kristallogr.*, vol. 129, pp. 396–404 (1969), and crystalline sodium silicate $\delta$-$Na_2Si_2O_5$ available from Clariant under the trade name Na-SKS-6.

The silicates used as component (C) exhibits alkalinity such that, when dissolved or dispersed in 20° C. ion-exchanged water in a concentration of 0.1 wt %, it yields pH of 11 or higher, and one liter of the solution or dispersion requires 5 ml or more of a 0.1N HCl aqueous solution to lower the pH to 10. It is distinguished from crystalline aluminosilicates, zeolite.

The amorphous silicate is compounded into a detergent base together with the above-described surface active agent, alkali metal carbonate and other detergent auxiliaries, or it is separately granulated and dry blended into the bleaching detergent formulation. Where compounded to make a detergent base, the amorphous silicate is a preferred component acting as a skeleton-forming agent to strengthen the detergent base particles. The crystalline silicate is preferably dry blended into the bleaching detergent formulation so as not to impair its ion-exchanging capability. A preferred silicate content in the bleaching detergent formulation is 0.1 to 20% by weight, particularly 1 to 50% by weight.

A preferred content of component (C) in the bleaching detergent formulation ranges from 1 to 60% by weight, particularly 1 to 50% by weight.

The bleaching detergent formulation preferably contains a bleach activator as component (D). Suitable bleach activators include tetraacetylethylenediamine, alkanoyloxybenzenesulfonic acids having 5 to 15 carbon atoms, alkanoyloxybenzenecarboxylic acids having 5 to 15 carbon atoms, and their salts. Examples of preferred bleach activators are octanoyloxy-p-benzenesulfonates, nonanoyloxy-p-benzenesulfonates, decanoyloxy-p-benzenesulfonates, dodecanoyloxy-p-benzenesulfofnates, octanoyloxy-p-(or -o-)benzenecarboxylic acid and its salts, nonanoyloxy-p-(or -o-)benzenecarboxylic acid and its salts, decanoyloxy-p-(or -o-)benzenecarboxylic acid and its salts, and dodecanoyloxy-p-(or -o-)benzenecarboxylic acid and its salts. Nonanoyloxy-p-benzenesulfonates, decanoyloxy-p-benzenesulfonates, dodecanoyloxy-p-benzenesulfonates, and decanoyloxy-p-benzenecarboxylic acid or its salts are particularly preferred. The most preferred are dodecanoyloxy-p-benzenesulffonates for their bleaching performance. The salts of the above-recited compounds include a sodium salt, a potassium salt, a magnesium salt, an alkanolamine salt, and an ammonium salt, with a sodium salt, a potassium salt, and a magnesium salt being suitable for their solubility.

The bleach activator as component (D) maybe incorporated into particles (A) or separately granulated and dry blended with other particles. The bleach activator compound can be granulated by, for example, the process described in JP-A-8-3593 or JP-A-2-25800.

A preferred content of component (D) in the bleaching detergent formulation is from 0.01 to 20% by weight, particularly 0.1 to 10% by weight, especially 0.1 to 5% by weight.

It is preferred for the bleaching detergent formulation to contain an enzyme, such as a cellulase, a protease, and a lipase, as component (E). Alkaline cellulases produced by an alkaliphilic *Bacillus* strain, *Bacillus sp.* KSM-635 (FERM BP-1485), or a mutant thereof are particularly preferred enzymes for bringing about improved detergency. Alkaline cellulases have an optimum pH for growth of 7 or higher with carboxymethyl cellulose as a substrate or exhibit 50% or more activity at pH 8 or higher relative to the activity at the optimum pH. Granular alkaline cellulase preparations are available from, e.g., Kao Corp. under the trade name of KAC500.

Proteases which can be used preferably include alkaline proteases, such as those produced by *Bacillus sp.* KSM-K16 (FERM P-11418) and *Bacillus sp.* KSM-K14 (FERMP-12587). Commercially available protease preparations include Alkalase, Savinase (from Novo Nordisk), Maxapem (from Genencor), and KAP4.3G (from Kao Corp.).

The enzymes are preferably added as a granular preparation obtained by filtering the culture, concentrating the filtrate, drying the concentrate to powder, and granulating the powder. The granular enzyme preparation is preferably prepared separately from particles (A) and component (B). Commercially available granular enzyme preparations can be utilized. The granular enzyme preparation preferably has an enzyme powder content of 0.5 to 30% by weight, particularly 0.8 to 25% by weight. Such a granular enzyme preparation is preferably added to the bleaching detergent formulation in an amount of 0.1 to 10% by weight, particularly 0.2 to 8% by weight, especially 0.3 to 5% by weight.

For further improving bleaching and cleaning effects, it is desirable for the bleaching detergent formulation to further contain a surface active agent as component (F) apart from the surface active agent usable as a binder for component (a) in particles (A). Examples of surface active agents useful as component (F) include anionic surface active agents, such as alkylbenzenesulfonates having 10 to 20, particularly 10 to 15, carbon atoms in the alkyl moiety, alkylsulfates having 8 to 18, particularly 10 to 14, carbon atoms in the alkyl moiety, and polyoxyethylene alkyl ether sulfates having 8 to 18, particularly 10 to 14, carbon atoms in the alkyl moiety. These surface active agents can be used either individually or as a combination of two or more thereof. The polyoxyethylene alkyl ether sulfates preferably have an average of 1 to 20 moles, particularly 1 to 10 moles, especially 1 to 5 moles, of an ethylene oxide unit (hereinafter referred to as EO). The counter ion of these anionic surface active agents is preferably an alkali metal ion, e.g., a sodium ion or a potassium ion. Other anionic surface active agents, nonionic surface active agents, cationic surface active agents or amphoteric surface active agents are also useful as component (F). For example, anionic surface active agents, such as olefin sulfonates, alkanesulfonates, fatty acid salts, alkyl or alkenyl ether carboxylates, α-sulfofatty acid salts, and a-sulfofatty acid esters; nonionic surface active agents, such as polyethylene oxide, polypropylene oxide, ethylene oxide/propylene oxide copolymers, polyethylene glycol alkyl or alkenyl ethers, polyethylene glycol alkylphenyl ethers, higher fatty acid alkanolamides or alkylene oxide adducts thereof, sucrose fatty acid esters, and alkyl glycosides; cationic surface active agents, such as quaternary ammonium salts; or amphoteric surface active agents, such as amine oxides, sulfobetaines, and carbobetaines. Preferred of these surface active agents are polyethylene glycol alkyl or alkenyl ethers having 10 to 20, particularly 10 to 18, carbon atoms in the alkyl or alkenyl moiety and an average of 4 to 20 moles, particularly 4 to 15 moles, of EO, and fatty acids having an alkyl group having 10 to 18 carbon atoms or an alkyl group composition of coconut oil or beef tallow origin or sodium or potassium salts thereof. A preferred content of component (F) in the bleaching detergent composition is 0.1 to 60% by weight, particularly 0.1 to 50% by weight, especially 0.5 to 40% by weight, from the standpoint of bleaching detergency and latherability.

For further improving bleaching and cleaning performance, it is preferred for the bleaching detergent formulation to further contain a polymer as component (G). Suitable polymers as component (G) include carboxylic acid homo- or copolymers, such as polyacrylic acid, polymethacrylic acid, polyhydroxyacrylic acid, and acrylic acid/maleic acid copolymers, and nonionic polymers such as polyethylene glycol. Preferred of them are polyacrylic acid or polyhydroxyacrylic acid or their salts having a weight average molecular weight of 5,000 to 20,000, acrylic acid/maleic acid copolymers (2/8 to 8/2 by mole) having a weight average molecular weight of 30,000 to 80,000, and polyethylene glycol having a weight average molecular weight of 4,000 to 10,000. A preferred content of component (G) in the bleaching detergent formulation is 0.05 to 20% by weight, particularly 0.1 to 10% by weight.

Other components that can be optionally added to the bleaching detergent formulation of the present invention include metal-ion exchangers for reducing calcium, magnesium or like ion concentrations of tap water or for improving powder properties of the particles, such as A type or P type zeolite having an average particle size of 0.1 to 10 μm, preferably 0.1 to 5 μm; chelating agents, such as ethane-1,1-diphosphonic acid and ethane-1,1,2-triphosphonic acid salts; defoaming agents, such as silicone oil/silica supported on polyethylene glycol or a cellulosic compound; sodium sulfate as an extender of a detergent base; fluorescent dyes; fragrances; and the like.

In compounding the aforementioned components, particles (A) (particles containing component (a)) and component (B) are compounded as independent particles as previously stated. Other components are preferably compounded in the form of particles separately from particles (A) and component (B) particles. Still preferably, component (D) and component (E) are compounded as independent particles. Component (C) may be compounded as particles separate from the other components but is preferably granulated together with component (F), component (G), and other components.

The above-described detergent components can be used as powder or granules. The bleaching detergent formulation of the invention can be prepared in a known manner with no particular restriction. The formulation is preferably a granular preparation having a high bulk density. Component (a) can easily be formulated into highly bulky particles (A) by granulation techniques. Component (B) can be made into highly bulky particles by using particles of 100 μm or greater. Components (D) or (E) can also be made into highly bulky particles by adopting specific granulation techniques, such as extrusion granulation.

Other components can be made into highly bulky particles by various methods using a slurry or an intimate mixture from, for example, components (C), (F), and (G), zeolite, and other detergent components which are selected so as to fit for the method. For example, (1) the kneaded mixture is extruded into granules, or (2) the kneaded mixture is dried, ground, and classified. (3) The slurry is spray dried followed by grinding. (4) Spray-dried particles having a reduced surface active agent concentration may be treated with an nonionic surface active agent. (5) Particles comprising the components and an oil-absorbing carrier are directly treated with an nonionic surface active agent. The details for carrying out these methods are disclosed in JP-A-61-69897, JP-A-61-69899, JP-A-61-69900, JP-A-2-222498, JP-A-2-222499, JP-A-3-33199, JP-A-5-86400, JP-A-5-209200, JP-A-9-87690, and WO99/29830. Zeolite, used as a granule surface modifier, can be added in a small amount during granulation or immediately before completion of granulation. The crystalline silicate, if used, is preferably added during the above-mentioned operation for making highly bulky particles or dry-blended with other particles. The alkali metal carbonate, if used, can be added into the slurry or during granulation or dry-blended with other particles. In addition to the use as a granule surface modifier, zeolite is preferably added before addition of component (B) because component (B) easily decomposes in the presence of zeolite.

The bleaching detergent formulation of the present invention desirably has an average particle size of 200 to 1,000 μm, particularly 200 to 600 μm, to provide favorable powder properties. The bleaching detergent formulation preferably has a bulk density of 0.5 to 1.2 g/cm$^3$, particularly 0.6 to 1.0 g/cm$^3$.

The bleaching detergent formulation of the invention is used at a concentration fit for the manner of laundering (whether clothes are laundered in a washing machine or soaked, etc.), the laundry load, the amount of wash water, the amount of soil, the operation mode of a washing machine, and the like. For instance, an advisable concentration ranges 0.03 to 0.3% by weight for laundering in a washing machine and 0.1 to 2% by weight for soaking.

The present invention also provides a bleaching method using the above-described bleaching detergent formulation. In carrying out the bleaching method of the invention, it is preferred to use an aqueous solution comprising components (a), a component derived from component (B) (hereinafter referred to as component (b)), and component (C) for producing enhanced detergency.

The present invention provides a method of bleaching fabric comprising bringing fabric into contact with an aqueous solution comprising (a) 0.1 to 5 ppm by weight of the compound of formula (I), (b) hydrogen peroxide, and (C) an alkali agent and having a pH of 8 to 12 at 20° C. for a period of 5 to 180 minutes under such conditions that the effective oxygen concentration in the aqueous solution is 10 to 500 ppm by weight.

The aqueous solution which can be used in the bleaching method of the invention is prepared by using particles (A) which contain the compound of formula (I) as component (a). The preference as for $R^1$, $R^2$, $R^4$, M, and X in formula (I) as described above applies to the application to the bleaching method.

The hydrogen peroxide as component (b) is preferably one derived from component (B).

Suitable examples of the alkali agent used in the aqueous solution as component (C) are sodium carbonate, potassium carbonate, monoethanolamine, diethanolamine, triethanolamine, trisodium phosphate, disodium hydrogenphosphate, a silicate, and mixtures thereof. Sodium carbonate, potassium carbonate, a silicate, and monoethanolamine are preferred.

The silicate as component (C) preferably includes amorphous sodium silicate, such as No. 1, 2 or 3 sodium silicate (specified in JIS K1408), crystalline silicates described in JP-A-7-89712, JP-A-60-227895, *Phys. Chem. Glasses*, vol. 7, pp. 127–138 (1966), and *Z. Kristallogr.*, vol. 129, pp. 296–404 (1969), and crystalline sodium silicate $\delta$-$Na_2Si_2O_5$ available from Clariant under the trade name Na-SKS-6.

The term "silicates" as used in the bleaching method has the same alkalinity as described with respect to component (C) of the bleaching detergent composition.

A preferred concentration of the alkali agent as component (C) for obtaining high bleaching performance is 100 to 2000 ppm (by weight, hereinafter the same), particularly 100 to 1500 ppm, especially 100 to 1000 ppm.

If the compound of formula (I) is used as a bleaching agent for fabric in an ordinary manner, it produces insufficient bleaching effect. The present inventors have found that this is because the compound of formula (I) serves to decompose hydrogen peroxide rather than acts on the fabric to be bleached. They have also found that constant existence of hydrogen peroxide in a specific concentration range not only draws high bleaching performance from the compound of formula (I) but prevents fabric damage. That is, the aqueous solution should maintain an effective oxygen concentration of 10 to 500 ppm while fabric to be bleached is in contact therewith for at least 5 minutes. The effective oxygen concentration is preferably kept in a range of from 10 to 300 ppm, particularly 10 to 100 ppm, for 5 minutes or longer. With such an effective oxygen concentration, a satisfactory bleaching effect is produced without causing damage to fabric.

In order to control the effective oxygen concentration of the aqueous solution within the range of 10 to 500 ppm, it is a preferred manipulation to control the dissolution rate of a percarbonate as component (B) by the above-described coating thereby to control generation of hydrogen peroxide. A preferred dissolution rate of a percarbonate is 0.05 to 1.5 g/min, particularly 0.1 to 1.1 g/min, as measured according to the method described above.

The aqueous solution has a pH of 8 to 12, preferably 9 to 11, still preferably 9.5 to 11, at 20° C.

It is preferred for the aqueous solution to further contain a surface active agent to exhibit detergency. A preferred content of a surface active agent is 50 to 2000 ppm, particularly 100 to 1000 ppm, especially 200 to 800 ppm, from the standpoint of detergency and latherability.

It is preferred for the aqueous solution to contains a bleach activator to further improve the bleaching and cleaning effects. A preferred initial concentration of the bleach activator in the aqueous solution is 2 to 500 ppm, particularly 5 to 300 ppm.

The aqueous solution can contain an enzyme. A preferred enzyme content is 0.1 to 50 ppm, particularly 0.5 to 10 ppm, in terms of protein content.

The aqueous solution preferably contains a chelating agent to remove water hardness components such as calcium ions. Useful chelating agents are listed below. Preferred of the list are groups (2), (3), (5), and (6) for their detergency improving effects.

(1) Phosphoric acid salts, such as orthophosphates, pyrophosphates, tripolyphosphates, metaphosphates, hexametaphosphates, and inositol hexaphosphate.

(2) Phosphonic acid salts, such as ethane-1,1-diphosphonates, ethane-1,1, 2-triphosphonates, ethane-1-hydroxy-1,1-diphosphonates, and their derivatives; ethanehydroxy-1,1, 2-triphosphonates, ethane-1,2-dicarboxy-1,2-diphosphonates, and methanehydroxyphosphonates.

(3) Phosphonocarboxylic acid salts, such as 2-phosphonobutane-1,2-dicarboxylates, 1-phosphonobutane-2,3,4-tricarboxylates, and $\alpha$-methylphosphonosuccinates.

(4) Amino acid salts, such as aspartates, glutaminates, and glycine salts.

(5) Aminopolyacetic acid salts, such as nitrilotriacetates, iminodiacetates, ethylenediaminetetraacetates, diethylenetriaminepentaacetates, glycol ether diaminetetraacetates, hydroxyethyliminodiacetates, triethylenetetraminehexaacetates, and djenkolates (6) Polyelectrolytes, such as polyacrylic acid, acrylic acid/maleic acid copolymers, polyfumaric acid, polymaleic acid, poly-$\alpha$-hydroxyacrylic acid, polyacetalcarboxylic acid, and their salts.

(7) Salts of polycarboxylic acids, such as diglycolates, hydroxydisuccinates, carboxymethyloxysuccinates, citrates, lactates, tartrates, oxalates, maleates, gluconates, carboxymethylsuccinates, and carboxymethyltartrates.

The bleaching method of the invention includes the step of bringing fabric to be bleached into contact with the above-described aqueous solution having the above-described effective oxygen concentration by soaking, impregnation or a like operation. The soaking is a state that fabric is completely immersed with the aqueous solution, either stirred or still. A preferred weight ratio of fabric to the aqueous solution is 1/1 to 1/30, particularly 1/5 to 1/30. The temperature of the aqueous solution while in contact is preferably 5 to 50° C., still preferably 10 to 40° C. The contact time is 5 to 180 minutes, preferably 5 to 120 minutes, still preferably 5 to 60 minutes. After the contact treatment, the fabric is rinsed with water, dewatered, and dried spontaneously.

The aqueous solution may be prepared on demand by dissolving the constituent components in water, or by diluting with water a previously prepared composition comprising the components in prescribed concentrations. The composition may have any form, such as powder, solid, paste, or liquid. For ease of dissolving, a powdered or liquid formulation is convenient.

The fabrics which can be bleached by the bleaching method of the invention include woven fabric, knitted fabric, nonwoven fabric, laminated fabric, double-woven fabric, and multi-woven fabric fabricated of natural fibers, e.g., cellulosic fibers and animal fibers, regenerated cellulosic fibers, semi-synthetic fibers, and synthetic fibers, e.g., polyamide fiber, polyester fiber, and acrylic fiber. More specifically, the bleaching method is applicable to articles made of these fabrics which are used in houses and are cleaned in houses, such as clothes, sheets, rugs, curtains, towels, shoes, and so forth.

EXAMPLES

The present invention will now be illustrated in greater detail with reference to Preparation Examples and Examples, but it should be understood that the invention is not deemed to be limited thereto. Unless otherwise noted, all the percents and parts are given by weight.

Granules were prepared in Preparation Examples. The following bleach catalysts were used.

Bleach catalyst A (disclosed in JP-W-12-515194):

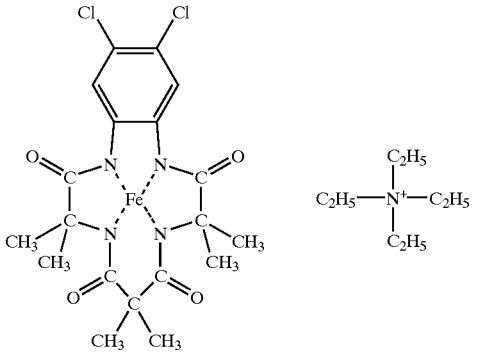

Bleach catalyst B (a manganese complex disclosed in JP-A-4-270298):

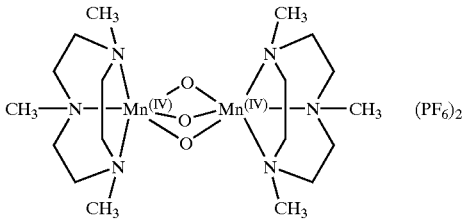

Bleach catalyst C (a cobalt complex disclosed in JP-W-10-513215)

$[Co(NH_3)_5OOCCH_3]^{2+}.2Cl^-$

Preparation Example 1-1

Preparation of Granules a-1

In a jacketed high-speed mixer (Model FS-GC-10, supplied by Fukae Kogyo K. K.) were put 5 parts of bleach catalyst A and 95 parts of polyethylene glycol having a weight average molecular weight of 8,000 (available from Aldrich) (hereinafter abbreviated as PEG) to make 5000 g. PEG and myristic acid had previously been melted at 80° C. The mixture was kneaded under conditions of a jacket temperature of 80° C., a stirring speed of 200 rpm at the main axis and 1500 rpm at grinding blades. When the temperature of the mixture reached 70° C., the mixture was transferred to an extrusion granulator (Pelleter Double EXD-100, supplied by Fuji Paudal Co., Ltd.) and extruded through a screen having a pore size of 800 μm. The extrudate was cooled on a vibration cooler (Vibro/Flow Drier DVF/6000, supplied by Fuji Paudal) and ground in a particle sizer (Knife Cutter FL-200, from Fuji Paudal). The grinds were classified to obtain granules a-1 having an average particle size of 900 μm.

Preparation Example 1-2

Preparation of Granules a-2

Granules a-2 were prepared in the same manner as in Preparation Example 1-1, except for replacing bleach catalyst A with bleach catalyst B.

Preparation Example 1-3

Preparation of Granules a'-1

Granules a'-1 were prepared in the same manner as in Preparation Example 1-1, except for replacing bleach catalyst A with bleach catalyst C.

Preparation Example 2-1

Preparation of Coated Sodium Percarbonate PC-1

In a mixing stirrer was put 1000 g of PC having an average particle size of 500 μm. While the PC was agitated at 250 rpm, 200 g of an aqueous solution containing 25% sodium metaboratetetrahydrate and 10% No. 1 sodium silicate was sprayed thereon. After the spraying, the agitation was continued for 10 minutes. The particles were dried in hot air to prepare coated sodium carbonate particles PC-1. PC-1 contained 0.4% sodium metaborate and 0.16% No. 1 sodium silicate based on PC, had an average particle size of 450 μm, and a dissolution rate of 0.5 g/min.

Preparation Example 2-2

Preparation of Coated Sodium Percarbonate PC-2

Ten kilograms of PC having an average particle size of 500 μm was put on a porous plate of a fluidized bed drier equipped with two spray nozzles. Hot air at 105° C. was blown from below the porous plate to fluidize PC. A 15% boric acid aqueous solution was sprayed from one of the nozzles at a rate of 80 g/min, and a 15% (in terms of $SiO_2$) aqueous solution of No. 1 sodium silicate was sprayed from the other nozzle at a rate of 20 g/min simultaneously while drying PC in a fluidized bed for 33 minutes to obtain coated sodium carbonate PC-2 having an average particle size of 460 μm. PC-2 contained 4% boric acid and 1% $Sio_2$ based on PC and had a dissolution rate of 0.3 g/min.

Preparation Example 2-3

Preparation of Coated Sodium Percarbonate PC-3

Ten kilograms of PC particles having an average particle size of 500 μm were coated with boric acid and sodium silicate to obtain coated sodium carbonate PC-2 having an average particle size of 460 μm in the same manner as in Preparation Example 2-2, except for doubling the spray-coating time. The PC-2 contained 8% boric acid and 2% $SiO_2$based on PC and had a dissolution rate of 0.1 g/min.

Preparation Example 3

Preparation of Granules c-1

A mixture consisting of 70 parts of sodium dodecanoyloxybenzenesulfonate, 5 parts of polyalkylene glycol lauryl ether having an average of 2 moles of EO, an average of 3 moles of a propylene oxide unit, and an average of 3 moles of EO added in blocks in this order, 5 parts of sodium polyoxyethylene lauryl ether sulfate having an average of 3 moles of EO, 5 parts of succinic acid, and 15 parts of PEG Granules c-1 was granulated in the same manner as in Preparation Example 1-1.

Preparation Example 4

Preparation of Particulate Detergent Base

Sodium (straight-chain $C_{12}$ alkyl)benzene sulfonate (2 kg), 0.5 kg of sodium lauryl sulfate, 0.3 kg of a polyethylene glycol alkyl ether ($C_{12-13}$ branched-chain primary alcohol having an average of 10 moles of EO), 0.3 kg of an acrylic acid/maleic acid copolymer (80:20 by mole; weight average molecular weight: 40,000), 0.3 kg of a sodium salt of beef tallow fatty acids, 0.6 kg of sodium carbonate, 1.5 kg of No. 1 sodium silicate, 1.5 kg of 4A zeolite (average particle size: 0.3 $\mu$m), 0.4 kg of sodium sulfate decahydrate, and 0.1 kg of PEG were dispersed in water to prepare an aqueous slurry having a solids content of 60%. The slurry was spray-dried, and the resulting particles were granulated by means of a high-speed mixer (Model FS-GC-10, supplied by Fukae Kogyo K.K.) to prepare a detergent base having an average particle size of 400 $\mu$m and a bulk density of 750 g/l.

Examples 1 and 2 and Comparative Examples 1 to 4

A bleaching detergent composition shown in Table 1 below was prepared by using the granules, the coated or uncoated PC, and the detergent base prepared in Preparation Examples. A 50 g portion of the composition was put into a specified wide-mouthed bottle (PS-No. 13K) and stored in a thermostat at 40° C. for 30 days. The bleaching and cleaning performance and the fabric damage preventive effect of the composition were evaluated according to the following methods. The results obtained are shown in Table 1.

Evaluation of Bleaching and Cleaning Performance

Curry-stained swatches for evaluation were prepared as follows. Retort pouch curry (Curry Marché, available from House Foods Corp.) was filtered through a mesh to remove solid matter, and the filtrate (curry liquid) was boiled. Swatches (10 cm×10 cm) of cotton shirting 2003 were boiled in the curry liquid for about 15 minutes. After allowed to stand for about 2 hours, the swatches were taken out, cleared of excess curry liquid with a spatule, dried spontaneously, and pressed.

Ten grams of the bleaching composition, before and after the storage, was dissolved in 2 liters of tap water, and five curry-stained swatches were soaked in the aqueous solution for 60 minutes, rinsed with tap water, and dried. The reflectance of the swatches was measured at 460 nm with NDR-101DP from Nippon Densyoku Industries Co., Ltd. to evaluate the bleaching performance in terms of a bleaching rate calculated by the following equation.

Bleaching rate (%)=(reflectance after bleaching−reflectance before bleaching)/(reference of clean swatch−reflectance before bleaching)×100

Evaluation of Fabric Damage Preventive Effect

Five red polo shirts (Polo Shirt S-701 Red, available from Shinmen K. K.) were washed in a two-tank washing machine (VH360S1, supplied by Toshiba Corp.) using 30 liters of tap water at 20° C. and the composition of Table 1 in a concentration of 0.0667% for 10 minutes, dewatered for 1 minute, rinsed with 30 liters of tap water for 5 minutes, dewatered, and hung up to dry in a room. The above laundering cycle was repeated 30 times. The conditions of the shirts were scored based on the following standards, and an average score of five shirts was rated as follows.

Standards for Scoring

1 . . . Practically as good as new.

2 . . . Slightly faded to an acceptable degree.

3 . . . Faded. Fiber damaged (frayed at the cuffs).

4 . . . Considerably faded. Fiber damaged.

5 . . . Considerable damage, such as tears.

Rating System

A . . . Average score of less than 2

B . . . Average score of 2 or greater and less than 2.5

C . . . Average score of 2.5 or greater and less than 3.5

D . . . Average score of 3.5 or greater

TABLE 1

| | Example | | Comparative Example | | | |
|---|---|---|---|---|---|---|
| | 1 | 2 | 1 | 2 | 3 | 4 |
| Formulation (wt %) | | | | | | |
| Granules a-1 | 0.5 | 0.5 | | 0.5 | | |
| Bleach Catalyst A[1)] | | | 0.05 | | | |
| Granules a'-1 | | | | | | 0.5 |
| Granules a'-2 | | | | | 0.5 | |
| Granules c-1 | 5 | | 5 | 5 | 5 | 5 |
| Detergent Base | 75 | 5 | 75 | 75 | 75 | 75 |
| PC-1 | 10 | 70 | 10 | | 10 | |
| PC-2 | | | | | | 10 |
| PC[2)] | | | | 10 | | |
| KAP4.3G[3)] | 0.8 | 0.8 | 0.8 | 0.8 | 0.8 | 0.8 |
| KAC500[4)] | 0.2 | 0.2 | 0.2 | 0.2 | 0.2 | 0.2 |
| Sodium Carbonate[5)] | 3 | 18 | 3 | 3 | 3 | 3 |
| Sodium Sulfate | bal. | bal. | bal. | bal. | bal. | bal. |
| Total | 100 | 100 | 100 | 100 | 100 | 100 |
| Bleaching Rate (%) | | | | | | |
| Pre-storage | 36 | 44 | 35 | 35 | 27 | 38 |
| Post-storage | 29 | 40 | 10 | 15 | 20 | 28 |
| Fabric Damage Preventing Effect | A | A | A | B | C | C |

Note:
[1)]Bleach catalyst A powder as such (non-granulated with a binder, etc.)
[2)]Uncoated sodium percarbonate from Nippon Peroxide Co., Ltd.
[3)]Protease from Kao Corp.
[4)]Cellulase from Kao Corp.
[5)]Soda ash dense Examples 3 and 4 and Comparative Examples 5 to 7

A bleaching aqueous solution having the formulation shown in Table 2 (unit: ppm by weight) was prepared by using the uncoated or coated sodium percarbonate prepared in Preparation Examples and other components shown in Table 2. The bleaching performance and fabric damage preventive effect of the aqueous solution were evaluated as follows. The results are shown in Table 2.

Evaluation of Bleaching Performance

Tea-stained swatches were prepared as follows. Nitto Tea (yellow package, available from Mitsui Norin Co., Ltd.) (80 g) was boiled in 3 liters of ion-exchanged water for about 15 minutes and strained through destarched and bleached cotton cloth. Swatches (10 cm×10 cm) of cotton cloth were soaked in the filtrate, boiled for about 15 minutes, and allowed to stand for 2 hours. The swatches were taken out, once dried spontaneously, washed with water repeatedly until the washing assumed no color, dewatered, and pressed.

Curry-stained swatches were prepared in the same manner as in Example 1.

Method 1

Five curry- or tea-stained swatches were soaked in 200 ml of each of the aqueous solutions of Example 3 and Comparative Examples 5 to 7 (fabric to aqueous solution weight ratio=1/20), rinsed with tap water, and dried. The bleaching rate (%) was obtained in the same manner as in Example 1.

Method-2

Five curry- or tea-stained swatches were soaked in 1 liter of the aqueous solution of Example 4 for 30 minutes. During the soaking, nine 1 ml portions of a 35% hydrogen peroxide aqueous solution were added to the aqueous solution at a 3 minute interval while lightly stirring. The swatches were rinsed with tap water and dried. The bleaching rate (%) was obtained in the same manner as in Example 1.

Evaluation of Fabric Damage Preventive Effect

The fabric damage preventive effect of the aqueous solution was evaluated by a procedure equivalent to that of Example 1, except for using 30 liters of the aqueous solution for 10 minute laundering. In Example 4, a 10 ml portion of a 35% hydrogen peroxide aqueous solution was added for every 2 minutes during the 10 minute laundering (four portions in total). The results were rated in the same manner as in Example 1.

Measurement of Effective Oxygen Concentration

The effective oxygen concentration of the aqueous solution was measured during the above test for evaluating bleaching performance by a usual titration method using a sodium permanganate aqueous solution. Measurement was made for every minute after the start of soaking. In Example 4 (method 2), each measurement was made before each addition of an aqueous hydrogen peroxide solution. The aqueous solution which kept an effective oxygen concentration in the range of 10 to 500 ppm for 5 minutes or longer or shorter than 5 minutes was judged "P (pass)" or "F (failure)", respectively. The results obtained are shown in Table 2.

The same measurement was carried out in the test for evaluating fabric damage preventive effect for every minute after the start of laundering. As a result, the effective oxygen concentration of the aqueous solutions of Examples 3 and 4 fell within the range of 10 to 500 ppm during the 10-minute washing.

TABLE 2

| | Example | | Comparative Example | | |
|---|---|---|---|---|---|
| | 3 | 4 | 5 | 6 | 7 |
| Formulation (Concentration in aqueous solution; ppm): | | | | | |
| Bleach Catalyst A | 1 | 1 | 8 | | |
| Bleach Catalyst B | | | | 1 | |
| Bleach Catalyst C | | | | | 1 |
| Hydrogen Peroxide | | 200 | | | |
| PC[1)] | 300 | | 300 | 300 | 300 |
| PC-1 | 500 | | 500 | 500 | 500 |
| PC-3 | 600 | | 600 | 600 | 600 |
| Sodium Carbonate[2)] | 200 | 300 | 200 | 200 | 200 |
| No. 1 Sodium Silicate | 100 | 100 | 100 | 100 | 100 |
| LAS[3)] | 300 | 300 | 300 | 300 | 300 |
| Softanol 70[4)] | 200 | 200 | 200 | 200 | 200 |
| LOBS[5)] | 10 | 10 | 10 | 10 | 10 |
| Polyacrylic Acid[6)] | 40 | 40 | 40 | 40 | 40 |
| KAP4.3G[7)] | 2 | 20 | 2 | 2 | 20 |
| KAC500[8)] | 2 | 2 | 2 | 2 | 2 |
| pH (20° C.) of Aqueous Solution | 10.5 | 10.5 | 10.5 | 10.5 | 10.5 |

TABLE 2-continued

| | Example | | Comparative Example | | |
|---|---|---|---|---|---|
| | 3 | 4 | 5 | 6 | 7 |
| Bleaching Performance: | | | | | |
| Test Method | 1 | 2 | 1 | 1 | 1 |
| Effective Oxygen Concn. | P | P | F | P | P |
| Bleaching Rate (%) | | | | | |
| Tea | 31 | 35 | 17 | 23 | 26 |
| Curry | 45 | 48 | 26 | 17 | 19 |
| Fabric Damage Preventing Effect | A | A | A | C | C |

Note:

1)Uncoated sodium percarbonate from Nippon Peroxide Co., Ltd.

2)Soda ash dense

3)Sodium ($C_{12-15}$ alkyl)benzenesulfonate

4)$C_{12-13}$ Mixed alkyl secondary alcohol having an average of 7 moles of EO added, available from Nippon Shokubai Co., Ltd.

5)Sodium lauryoyloxybenzenesulfonate

6)Having a molecular weight of 10,000 as measured by GPC using polyethylene glycol as a standard 7)Protease from Kao Corp.

8)Cellulase from Kao Corp.

While the invention has been described in detail and with reference to specific examples thereof, it will be apparent to one skilled in the art that various changes and modifications can be made therein without departing from the spirit and scope thereof.

The entire disclosure of each and every foreign patent application from which the benefit of foreign priority has been claimed in the present application is incorporated herein by reference, as if fully set forth.

What is claimed is:

1. A bleaching detergent formulation comprising the components of:

(A) particles comprising 0.01 to 50% by weight, based on the particles, of a compound represented by formula (I):

(I)

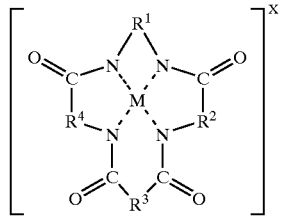

wherein $R^1$ represents a straight-chain alkylene or alkenylene group having 2 to 8 carbon atoms, a cycloalkylene or cycloalkenylene group having 3 to 8 carbon atoms or a phenylene group; $R^2$, $R^3$ and $R^4$, which may be the same or different, each represent a methylene group, a straight-chain alkylene or alkenylene group having 2 to 8 carbon atoms, a cycloalkylene group having 3 to 8 carbon atoms or a phenylene group; $R^1$, $R^2$, $R^3$ and $R^4$ may each have a substituent or substituents selected from an alkyl, alkenyl, alkynyl, alkoxy or halogenated alkyl group having up to 8 carbon atoms, a cycloalkyl or cycloalkenyl group having 3 to 8 carbon atoms, an aryl group, an aryl group having a straight-chain alkyl group having 1 to 18 carbon atoms, a hydroxyl group, a phenoxy group, a halogen atom, an amino group, a sulfuric acid radical, a sulfo group, a nitro group, and a carboxyl group; M represents a metal selected from transition metals having a I, II, III, IV, V, VI, VII or VIII-valent oxidized state; and X represents a counter ion in equilibrium with the compound's charges on a stoichiometric basis; and (B) sodium percarbonate particles coated with at least one coating material selected from a polymer, an inorganic salt, and an inorganic acid, and the component (B) has a dissolution rate of 0.05 to 1.5 g/min.

2. The bleaching detergent formulation according to claim 1, wherein the component (A) comprises a binder which develops tack or film-forming properties at or above 30° C. and does not melt below 30° C. in an amount of 0.5 to 99.99% by weight based on the component (A).

3. The bleaching detergent formulation according to claim 1, wherein the component (A) comprises a binder which develops tack or film-forming properties at or above 30° C. and does not melt below 30° C. in an amount of 0.5 to 99.99% by weight based on the component (A).

4. The bleaching detergent formulation according to claim 1, wherein the component (A) comprises an anionic surface active agent.

5. The bleaching detergent formulation according to claim 1, wherein the component (A) comprises an anionic surface active agent.

6. The bleaching detergent formulation according to claim 2, wherein the component (A) comprises an anionic surface active agent.

7. The bleaching detergent formulation according to claim 3, wherein the component (A) comprises an anionic surface active agent.

8. The bleaching detergent formulation according to claim 4, wherein the anionic surface active agent is one of an alkylsulfate, a polyoxyethylene alkyl ether sulfate and a mixture thereof.

9. The bleaching detergent formulation according to claim 1, which comprises 0.1 to 20% by weight of the component (A) and 0.5 to 99% by weight of the component (B), the component (A) comprising 0.01 to 50% by weight of the compound.

10. The bleaching detergent formulation according to claim 1, wherein the component (B) is sodium percarbonate particles coated with a total amount of 0.1 to 50% by weight, based on the sodium percarbonate, of at least one coating material selected from boric acid, a boric acid salt, a silicic acid salt, a carbonic acid salt, a sulfuric acid salt, a phosphoric acid salt, polyethylene glycol that is solid at 30° C., and a wax that is solid at 30° C.

11. The bleaching detergent formulation according to claim 1, which further comprises a component (C) an alkali agent.

12. The bleaching detergent formulation according to claim 11, wherein the component (C) is at least one of an alkali metal carbonate, a silicic acid salt, an alkanolamine, and an alkaliphosphates.

13. The bleaching detergent formulation according to claim 11, wherein the component (C) is sodium carbonate.

14. The bleaching detergent formulation according to claim 11, which comprises 0.1 to 10% by weight of the component (A), 1 to 90% by weight of sodium percarbonate as the component (B), the sodium percarbonate being coated with at least one of boric acid, sodium borate, sodium silicate, and magnesium sulfate, and 1 to 50% by weight of sodium carbonate as the component (C).

* * * * *